United States Patent [19]

Truzzi

[11] 3,986,473

[45] Oct. 19, 1976

[54] REMOVABLE BOAT STEERING AND SAIL PROPULSION UNIT

[76] Inventor: Giuseppe Truzzi, Via S. Paolo, I, Baranzate Di Bollate (Milan), Italy

[22] Filed: June 23, 1975

[21] Appl. No.: 589,642

[30] Foreign Application Priority Data

Sept. 20, 1974 Italy ..... 27527/74

[52] U.S. Cl. ..... 114/39

[51] Int. Cl.[2] ..... B63B 35/00

[58] Field of Search..... 114/39, 102, 126, 144 C

[56] References Cited

UNITED STATES PATENTS

| | | | |
|---|---|---|---|
| 3,008,442 | 11/1961 | Russell, Jr. | 114/39 |
| 3,191,569 | 6/1965 | Coombe | 114/39 |
| 3,859,943 | 1/1975 | Katainen | 114/39 |

*Primary Examiner*—Stephen G. Kunin
*Assistant Examiner*—Jesus D. Sotelo
*Attorney, Agent, or Firm*—Guido Modiano; Albert Josif

[57] ABSTRACT

A detachable steering and sail propulsion unit for boats which is self contained and removably attachable to the structure of a boat. The unit comprises, an upper propulsive structure including a sail, and a lower steering structure. The lower steering structure is journaled for rotation about a substantially vertical axis in a support structure removably secured to the boat and is controlled through a manually operated steering control lever. The unit also comprises sail trimming elements connecting the sail to the lower steering structure so as to transfer part of the side force acting on the sail to the lower steering structure.

8 Claims, 5 Drawing Figures

REMOVABLE BOAT STEERING AND SAIL PROPULSION UNIT

BACKGROUND OF THE INVENTION

The instant invention relates generally to the propulsion of boats by means of sails, and more particularly concerns a detachable boat steering and sail propulsion unit suitable for application to a variety of small craft.

Conventionally, the sail arrangement or rig of a sailing boat and the hull design thereof are related to each other in a substantially permanent and unmodifiable fashion, and a sailboat has to be designed and built integrally as such. In other words, hull and propulsion means constitute a substantially inseparable whole, wherein the sail(s) side force is counteracted by the side resistance set up both by the underwater portion of the hull and one or more suitable appendages thereof — e.g. fin keel(s), bilge keels, centerboard(s), leeboards, etc. — which are so conceived as to prevent the boat from making excessive leeway, or sideward motion, under the action of a wind blowing from one side of the boat; a directional apparatus, or helm and rudder assembly, permits the boat to be steered.

In some traditional sailboats, which like the "topo" and "bragozzo" of the Venetian lagoon, or even the "sampan" from the China coasts, have been developed for operation in comparatively protected and shallow water or for sailing free (i.e. with the wind direction making an obtuse angle to the boat direction of travel), said side resistance comes partly from the shape of the hull bottom, featuring a sharp longitudinal corner or chine, and partly from a wide and shallow rudder configuration, the blade whereof has a greater area than usual. The latter configuration has the disadvantage that sailing on the wind (i.e. with the wind direction making an acute angle to the boat direction of travel) is virtually impossible and, moreover, owing to the strong side pressure acting on the rudder blade, steering in a breeze soon becomes a difficult and tiring job.

Known in the art are also some special outfits for converting small or collapsible structure boats, such as inflatable boats and folding canoes, for sail propulsion, wherein the sail(s), leeway-preventing means (typically, two leeboards), and rudder, complete with their respective attaching means, are provided as three separate assemblies for attachment to the boat own structure by their respective means at the moment of use. The effectiveness of such arrangements is generally good, but they tend to be bulky, costly and heavy, and quite often their erection requires considerable time due to their comparative complexity.

SUMMARY OF THE INVENTION

Accordingly, it is an object of this invention to obviate the drawbacks of the prior art techniques, and specifically to provide a sail propulsion unit which is self-contained and can be removably attached to any type of boat, either singly or in combination with other similar units, by directly mounting the unit either to a hull edge portion, or to suitably arranged supporting members in the boat, or in a well incorporated within the hull and open at the bottom to the water whereon the boat is floating.

Another object of the invention is to provide a sail propulsion unit which in addition to being structurally and functionally independent of the boat whereto it is attached provides inherent self-steering capabilities.

A further object of this invention is to provide a detachable boat steering and sail propulsion unit which is versatile, safe and easy to operate even by inexperienced or debilitated persons, such as disaster survivors and the like, and this at any points of sailing.

Still another object of the invention is to provide a removable boat steering and sail propulsion unit which is in no way less efficient than a conventional sail rig, and can be quickly taken apart and stowed in a boat, not excluding motorboats, for subsequent assembly, installation and use in emergency circumstances or for fishing in waters where, like in some areas of the United States, fishing from powerboats is regulated.

Yet another object of the invention is to provide a removable boat steering and sail propulsion unit which can be manufactured easily and economically in a variety of versions and using an ample choice of materials.

A further object of this invention is to provide a detachable boat steering and sail propulsion unit which, in addition to being light in weight, at least in one embodiment thereof is fully or partially buoyant, owing to the lift force acting on its submerged portion, thereby relieving the boat of at least part of said unit weight.

These and other objects are achieved by the detachable boat steering and sail propulsion unit according to the invention, said unit being self-contained and removably attachable to the structure of a boat, and characterized in that it comprises a supporting means and attaching means for securing the unit to said boat, an upper propulsive structure carried by said supporting means and including a sail arranged for rotation through 360° about a substantially vertical axis and provided with means for the spreading, handling and trimming thereof, a lower normally immersed steering structure, said lower structure being journaled in said supporting means for rotation about a substantially vertical axis independently of said upper structure and controlled through a manually operated steering control means, in that when said upper and lower structures are oriented for sailing on the wind the side force application center of said sail and the center of application of the side resistance correspondingly opposed by said lower structure are both located with respect to the direction of advance of said boat abaft or behind the rotation axes respectively of said sail and lower steering structure, in particular said side resistance application center leading with respect to said side force application center, and in that said sail trimming means is interconnected to said lower steering structure such as to transfer part of said side force acting on said sail to said lower steering structure, thereby counteracting the torque set up by said lower steering structure about the substantially vertical rotation axis thereof due to the leeway-preventing action of said interconnected steering structure and keeping the boat at a substantially constant direction of advance or heading with respect to the wind angle of incidence to said sail.

BRIEF DESCRIPTION OF THE DRAWING

Further features and advantages of the invention will become apparent from the description of a preferred though not exclusive embodiment thereof which follows, illustrated by way of example and not of limitation in the attached drawings, wherein.

DESCRIPTION OF PREFERRED EMBODIMENTS

Figure 1:
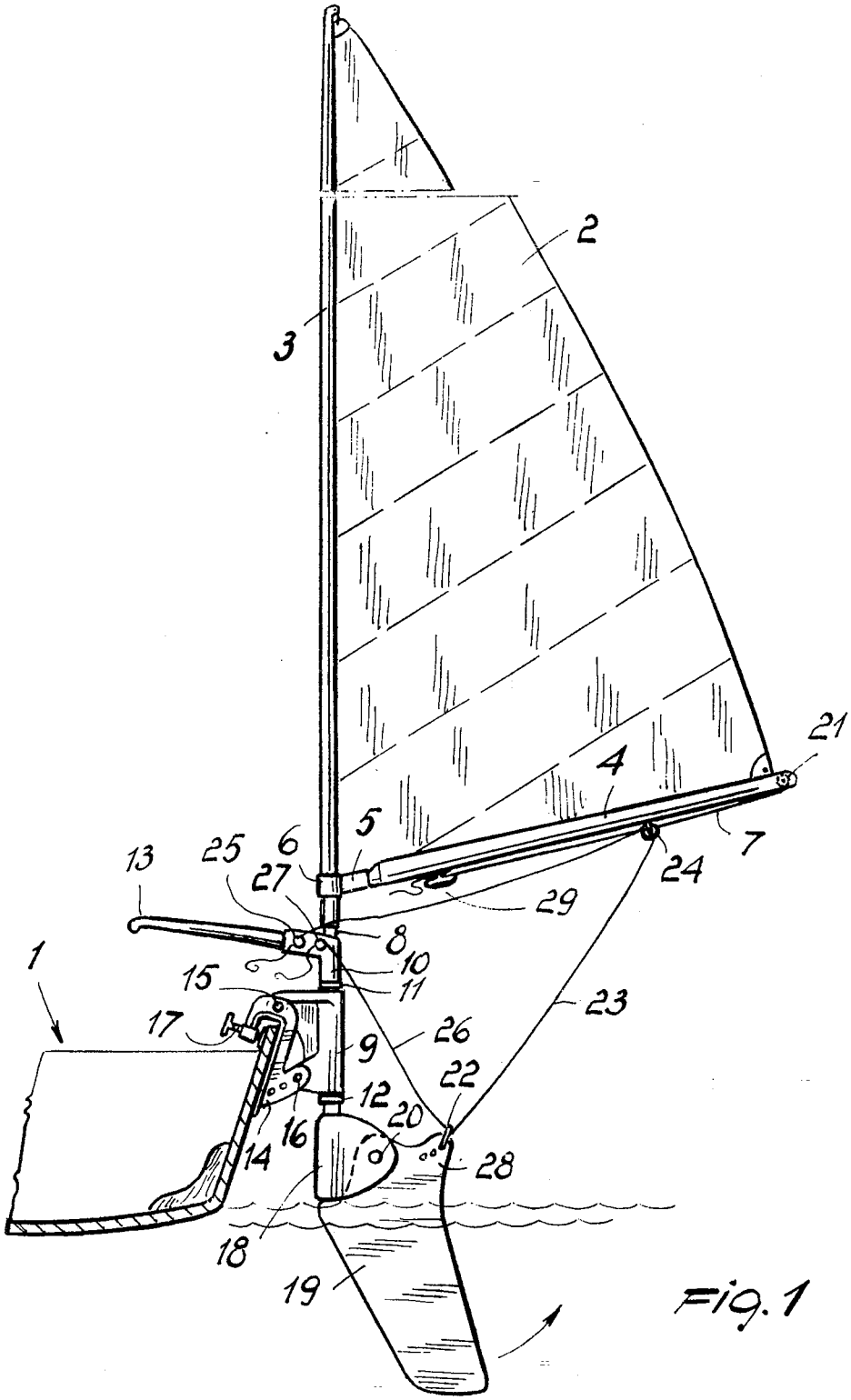
FIG. 1 is a left-hand or "port" side elevational view of a preferred embodiment of the unit according to the invention, shown together with a fragmentary and simplified representation of a boat in longitudinal section.
Figures 2, 3:
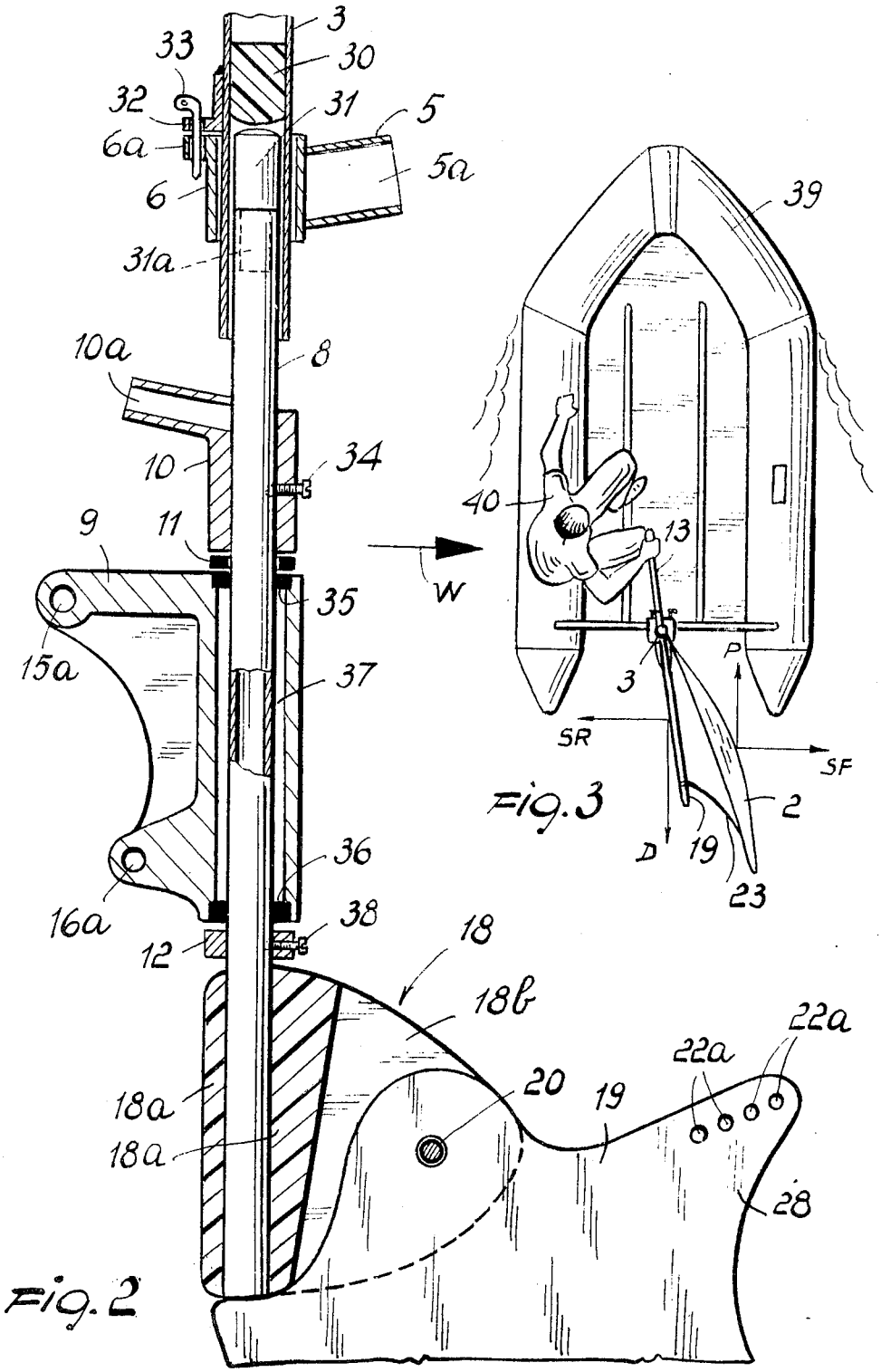
FIG. 2 is a partial longitudinal section view of the left-hand or port side of the middle portion of the embodiment in FIG. 1.
FIG. 3 is a plan view showing schematically how the unit operates in a typical utilization thereof.

Making reference to FIGS. 1 and 2 of the drawings, the after part or rear portion of a boat 1 is shown in longitudinal section to make the unit method of attachment to the hull more clearly understandable. An upper propulsive structure comprises a triangular sail 2 of a type commonly known as "Bermudian" or "Marconi", which is supported by a substantially horizontal member or boom 4 and substantially vertical member or mast 3, the mast being preferably composed of jointed or telescoping sections, each of such sections not to exceed the boom in length. For attaching or "bending" the sail 2 to the mast 3 and boom 4, the so-called pocket luff and groove methods, respectively, proved satisfactory in a prototype having about 3 square meters (32 square feet) of sail area. It also proved advantageous to have the mast made from aluminium tube of circular cross-section, almost entirely filled with closed cellular urethane foam, both for strength and flotation reasons. Masts are contemplated, however, which may be made of wood, reinforced resin, or extruded aluminium, in a variety of cross-sectional configurations. In the cited prototype, a boom of pinewood having a rectangular cross-section, grooved along its upper side, proved successful.

The sail 2 is stretched along the boom 4 by a rope means or clew outhaul attached on one end to the after corner or clew of the sail, while the other end, after passing over a pulley 21 provided in a recess within the boom 4, is secured or belayed to a cleat 29 or equivalent device, which is suitably located on the boom 4 in a position close enough to the mast 3 as to be within arm's reach from the boat 1. The upper corner or head of the sail 2 may be secured to the mast with any known adjustable and disengageable means, such as by tying, the same applying to the forward corner or tack of the sail. For simplicity reasons, the presence of a halyard proper, for units below 6–8 square meters (65–85 square feet) of sail area, is not contemplated. However, a masthead pulley may be installed, and a halyard free end belayed to a cleat similar to the cleat 29 most advantageously mounted to the mast 3, shortly above the attachment assembly 5, 6 of the boom 4 to the mast 3. The forward or fore end of the boom 4 is removably inserted, with a slight clearance such as to ensure for the opposite end thereof a limited oscillation in a vertical plane, into the recess 5*a* of a tubular metal fitting 5 the inside cross-section whereof mates the outside cross-section of the forward end of the boom 4, e.g. a rectangle with its longer sides arranged vertically, said fitting 5 being welded into a single component to a cylindrical collar or sleeve 6, of the same material, the latter embracing the lower portion of the mast 3 for rotation thereabout, said collar including a projection 6*a* provided with a vertical bore which when brought into alignment with a corresponding bore in a similar upper projection 32, affixed to the mast 3, receives a vertical pin 33 engaging both projections 6*a* and 32 through their bores, thereby making the mast 3, collar 6 and fitting 5, and the boom 4 rotatable as one component, as will appear hereinafter, the tensioned luff, or side of the sail engaged with the mast 3, holding the collar 6 against the projection 32, and the compression which acts at the sail foot, or side of the sail engaged with the boom, preventing the boom 4 from sliding undesirably out of the fitting 5. It is contemplated that the attachment of the boom 4, comprising the fitting 5 and the collar 6 with its projection 6*a*, be formed as an integral piece of plastic or reinforced resin material. Moreover, other means may be employed for removably attaching the boom to the mast.

The mast 3 is provided at the lower portion thereof and at a convenient distance from the open lower end of the mast, with an inner plug 30 of hard plastic material which is bonded to the inner wall of the mast 3 or otherwise secured thereto. The lower face of the plug 30 is made convex. An opposite hard plastic plug 31, having its upper or top face convex, is inserted with its tail portion 31*a* into a first cylindrical tubular pivot member 8, preferably of stainless steel, and bonded thereto. Therefore, when the mast 3 is slide or inserted over the upper end of the tube or pivot member 8, the plugs 30 and 31 come in mutual abutment relationship at a point, thereby the mast 3 step or base portion is pivotally supported without meaningful friction. It is contemplated, particularly for larger size versions of the unit exceeding approximately 9 to 10 square meters (95 to 105 square feet) of sail area, that the two plugs be replaced with suitable inside flange elements accomodating therebetween a thrust bearing of the rolling type.

In order to prevent excessive sideplay of the mast 3 over the pivot member 8, the open lower end of the mast 3 may be provided with an internal bushing or lining of a slippery material, so arranged as to remain in sliding contact with the outer wall of member 8.

The tube 8 is adapted to a tight fit within a plastic or aluminium sleeve member 10, whereto it is held fixed, e.g. by a setscrew 34 which threads into the sleeve member 10 and penetrates a mating hole in the tube 8, the sleeve member 10 being provided with an integral hollow projecting part or socket 10*a*, whereinto a directional control member 13 is inserted, e.g. a tiller of locust wood, serving as a lever to produce a desired rotation of the member 8. The sleeve member configuration may be of the split type having mating flanges clamped around the tube 8 by means of bolts traversing such flanges.

Lower down the unit, the tube 8 passes through a thrust washer 11, made of Tufnol (trademark) or other suitable material, and then through a supporting means 9, e.g. of die-cast aluminium, which is provided with a vertical bore 37 at the upper and lower ends whereof friction bearings, respectively 35 and 36, are seated which are made of the same material as the washer 11. In lieu of the washer 11 and friction bearings 35, 36, rolling bearings may be used preferably of Delrin (trademark) as being salt water resistant. The annular space between the tube 8 and inner wall of the bore 37 may be filled with a lubricant during factory assembling, as dictated by the nature of the bearings adopted.

The tube 8 extends downwards through a retaining collar 12, which may be made of plastic material and is positioned on the tube 8 in the same way as the sleeve member 10 wherewith it cooperates to lock the tube 8 axially within the supporting means 9. The tube 8 extends further down and through a lower steering structure which comprises a rigid member 18, made of either plastic or wood or any other suitable material, said rigid member 18 being penetrated from top to bottom at a solid portion 18*a* thereof by the tube 8, and attached to the latter by means of either transverse bolts (not shown) or adhesive or any other suitable means known in the art. The tube 8 terminates flush with the bottom side of the member 18.

The member 18 cooperates to support and guide a substantially flat plate appendage or fin 19, which is effective to both steer the boat and check her leeway. To this end, the member 18 is provided with a deeply recessed vertical and longitudinal cut or slotted portion 18*b* having parallel sides (best seen in longitudinal section in FIG. 2) and closed foward by the solid portion 18*a*, the rest of its periphery being left open, said slot accomodating an upper flat portion of the fin 19 having a thickness which is as far as possible constant throughout and equal to the width of the slot 18*b* but such as not to hinder the free sliding movement of said upper flat portion of the fin 19 within said slot. The fin 19 is held within the slot 18*b* by a transverse or cross pin 20, which may be advantageously a bolt with wing nut, passing through the member 18 and fin 19 at a point suitably located to allow the fin 19 to swing in an upward direction, as indicated by the arrowhead in FIG. 1, whilst preventing said fin from coming off the guide formed by the sides of the slotted portion 18*b*.

The fin 19 may be made of metal, wood, fiberglass or any other suitable materials, and in one embodiment of the invention is heavier than water, or so ballasted as to drop spontaneously to the approximate position shown in FIG. 1, beyond which the fin 19 cannot descend owing to its upper forward corner region abutting against the lower end of tube 8. If desired, any normal tendency of the fin 19 to resurface may be prevented, e.g. by means of an elastic cord or band attached to the upper forward corner of the fin, led up inside the tube 8 to a point slightly above the sleeve member 10, and from this point out through a hole drilled in the tube 8 to terminate in a cam cleat, or equivalent thereof, mounted to the sleeve member 10. The upper after or rear corner of the fin 19 ends in a projection or horn 28 suitably drilled with holes in order to attach thereto, by means of a shackle or equivalent thereof, a rope means or lanyard 26 for swinging up the fin, the lanyard upper end being engageable in a conventional cam cleat mounted to the sleeve member 10. From the same horn 28 another rope means 23, constituting the sail trimming means or sheet, goes through a block 24, removably attached to the boom 4, and terminates in a similar cam cleat 25, or is held in the hand by the operator.

It should be noted that the fin 19 may alternatively be made up of two plates having the same contours and dimensions and both mounted in a side by side relationship on the one pivot pin 20 and received in the same slot 18*b*, slightly widened if required, such plates being provided with respective lanyards similar to 26. In the latter embodiment, the sheet 23 would be attached to a horn similar to 28 but integral with the member 18 and arranged above the fin 19. Moreover, and advantageously, each of the two plates would be the mirror image of the other for what regards their force and aft section profile, i.e. they would have their confronting faces flat or slightly concave and their outer faces convex. By keeping immersed, as the occasion dictates, the plate with the convex face to windward, a much greater side resistance would be opposed to the sail side force, thereby the fin 19 could be made smaller, although this approach would cause a slight dissymmetry in the steering effect, as is known from the dynamics of wing sections.

The supporting means 9 comprises essentially a rigid structure of C-like configuration, an upper boss whereof, bored with a horizontal transverse hole 15*a*, is adapted to a close fit in the unit attachment means comprising two metal brackets 14 interconnected together by means of cross members (not shown), whereto it is secured by a transverse pin or through bolt 15 and related nut, thereby the upper boss of the means 9 is held clamped to a slight friction between the brackets 14, anti-friction washers (not shown) being interposed therebetween. The brackets 14 are provided with one or two clamp screws 17 for securing the unit to the boat hull or structure, as is well known in the outboard motor art. The brackets 14 are formed at their lower ends with extensions drilled with a set of holes arranged in an arc of a circle centered on the bolt 15 axis, and a removable rod 16 is inserted in a selected hole in one of the brackets 14, passed through a hole 16*a* in a lower boss of the C-like structure, and finally through a corresponding hole in the opposite bracket, thus constraining the means 9 and the whole unit to a desired vertical position.

FIG. 3 shows schematically how the unit according to the invention operates, typically under the action of a constant wind abeam W, i.e. a wind blowing at 90° to the direction of advance of an inflatable boat or dinghy 39 which is represented as moving toward the top of the sheet.

The unit according to the invention is attached in this case to the transom of the dinghy 39, and an operator 40 sits as usual on the windward buoyancy tube of the inflatable dinghy in order to counteract with his own weight the overturning or heeling couple due to the side force SF of the sail 2 and side resistance SR of the fin 19. The force P is the propulsive or useful component of the sail, and the resistance D identifies the drag component of the fin 19; the points of application of the force SF and force SR are both located abaft or behind the axes of rotation, respectively of the sail and fin, about the pivot member 8 of the supporting means 9, the point of application of the force SR, or side resistance center, leading in the representation of FIG. 1, i.e. with the wind abeam as in FIG. 3 or with the boat closed hauled, with respect to the point of application of the force SF, or side force center.

The operator 40 grasps the steering means or tiller 13 and brings the fin 19 to a centered or fore-and-aft orientation; then, after freeing the sheet 23 from the cleat 25 (FIG. 1), he trims the sail 2 for the desired heading or point of sailing. As soon as the dinghy 39 gathers speed, the operator 40 can, if desired, engage again the sheet 23 with the cleat 25 (FIG. 1), and leave the unit to steet itself unattended.

In fact, the side resistance SR is due not only to the force opposed by the water while the boat is moving foward, which force causes the fin 19 to be constantly biased toward a centered position, but also to the force which the water opposes to side displacement of the boat under the wind action in direction W, which force would cause the pivotable fin 19 to assume a position transverse to the direction of movement of the boat in the direction of arrow SR if the fin 19 would not be connected to the sail. Under the circumstances set forth below it is possible to achieve a state of equilibrium between SR and SF such that the fin is positioned to cause rectilinear forward movement of the boat. This state of equilibrium is then substantially maintained even if there occurs a variation in the wind speed. In fact, if the wind speed decreases, then the sheet 23 transmits a reduced pull to the fin 19 due to the reduced force SF, thereby the fin itself is subjected to a lesser force SR, so that the dinghy remains undeviated from its course. On the other hand, if the wind speed increases, then the force SF increases and so does the pull of the sheet, the latter rotates the fin slightly to leeward, thus increasing the angle of attack thereof to the water and, consequently, increasing the force SR which, on the one side is proportional to the dinghy speed or increase of P caused by the wind speed increase and grows rapidly higher even for small angular movements of the fin, and on the other side increases for the increased tendency to leeward displacement; thereby the dinghy does not react luffing or turning sharply to windward as it would if the sail trimming means or sheet 23 were set independent of the fin 19. Furthermore, since the moment of SR is counteracted by the moment of SF, no physical exertion is required on the part of the operator 40 in the form of a pull on the tiller 13 in the same direction as SR.

It is important to remark that when it is preferred to hold the tiller 23 in the hand to follow a twisting course, it is possible within limits to steer without operating the sheet 23, much better than with a conventional sailboat configuration. In fact, when the tiller 13 is moved to windward in order to bear up or turn to leeward, it is apparent that the sail, being interconnected to the fin through the sheet, is also bound to move or rotate further to leeward, so that the consequent forward shift of the side force center favors the manoeuver. When luffing or turning to windward, the sail is brought more to windward, again by the fin through the sheet, the side force center moves backwards and the manoeuver is again facilitated.

The importance of some provisions mentioned hereinabove will become apparent when referred to the operation just described. It should first be noted that the effects described would also depend on the size and hydrodynamic configuration of the fin 19 in relation to the sail 2. Since the actual size of the fin is dependent on the efficiency thereof, both for what concern its sectional and contour profiles, rake or inclination, etc., it is not possible to indicate any fixed proportion of the sail to fin areas. However, it has been found that when the fin 19 is a thin flat plate with sharp or tapering edges, and shaped approximately as shown in FIG. 1, a ratio of sail area to fin area of 17.5:1 is satisfactory.

Actual tests have confirmed that a balance between the forces involved is not critical to maintain, even though the side force and side resistance set up by the boat itself may vary considerably. The embodiment shown in FIGS. 1 and 2 offers, for instance, three possibilities for adjustment to suit the boat characteristic requirements, namely: (1) shifting the attachment point of the sheet 23, by using another one of the holes 22*a* and/or changing the position of the block 24 along the boom 4; (2) tilting the fin 19 by operation of the rope means 26; and (3) raking or inclining the entire unit by shifting the rod 16 in different holes in the brackets 14 of the unit attaching means.

When the wind increases to a speed that may be dangerous for a sailboat, it is common practice to shorten or reduce sail. The embodiment of FIGS. 1 and 2 allows for a quick method of accomplishing this reduction in sail area. For convenience reasons, the sheet 23 is first eased temporarily to let the sail flutter in the wind; then the outhaul 7 is paid out and the pin 33 removed in order to disengage the mast 3 from the boom 4; thereafter, the mast is turned in the hands to just roll upon it the desired amount of sail; lastly, the pin 33 is reinserted back into the bores in the projections 32 and 6*a*, the outhaul 7 is reset, and sailing is resumed by trimming the sail with the sheet 23.

If desired, the bottom portion of the mast 3 may be provided with a handwheel to facilitate the rolling in and out of the sail.

It could be objected that the manoeuver just described results in a forward shift of the sail center of effort, thus affecting the close-hauledness of the boat or ability of the boat to sail to windward or by the wind. In the actual practice, this effect is felt only for quite substantial reductions of the sail area (at least 40%), thanks to the fact that the invention prefers sails of high aspect ratio, i.e. tall and narrow ones. However, the problem should never be a serious one, and may be obviated by the adjustment methods mentioned above. Anyhow, when a small boat is compelled to shorten sail by more than 40%, it is unlikely that the state of the water would make sailing by the wind a practicable proposition.

Also apparent is the possibility of installing the unit according to this invention on one side of the boat, e.g. the starboard or right-hand side, since the supporting means and attaching means provide for rotation of the unit through an arc of 360°. With this type of installation, however, it is no longer possible to make use of the adjustment method utilizing the rod and set of holes in the bracket 14, and that method would have to be substituted for by the shifting of the entire unit in a fore and aft direction along the boat gunwale. Moreover, the tiller 13 would be best replaced by another tiller curving inboards, for convenience reasons, or otherwise provided with a swivel jointed extension member.

The ease of disassembly of the unit for transport comes from the fact that the mast 3 is made up of detachable sections, that the boom 4 and sail 2 can be removed from the unit, that the fin 19 can be detached by unscrewing the wing nut of the pivot bolt 20 and withdrawing the pivot bolt, and that the tiller can be removed from its socket 10*a*.

Furthermore, the possibility of installing two or more units according to the invention in the same boat is obvious, and two such units may be mounted, for instance, in a side by side relationship, interconnecting the tillers 13 by means of a tie bar similar to the ones already in use in multihull sailboats, thereby providing a biplane rig, or a triplane one, etc.

Surprisingly, actual tests demonstrated a substantial performance difference between the traditional or conventional sail rig and the unit according to the invention, in favor of the latter. It is considered that this may be attributed to the reduced wetted area and absence of interfering eddy formations between centerboard (or keel, etc.) and rudder, as is instead the case with the known configuration. Moreover, it may be that such superior performance results from the sail being located away from the turbulent air flow created by the windward side of the hull.

The invention as described hereinabove is susceptible to several variations and modifications, well within the scope of the instant concept. Thus, for example, the capability of the fin 19 to swing up and down, although a useful feature, at least for clearing submerged obstructions, is not a strict requirement of the invention, while other means may be devised of attaching the boom to the mast, as well as the unit to the boat.

Figure 4:
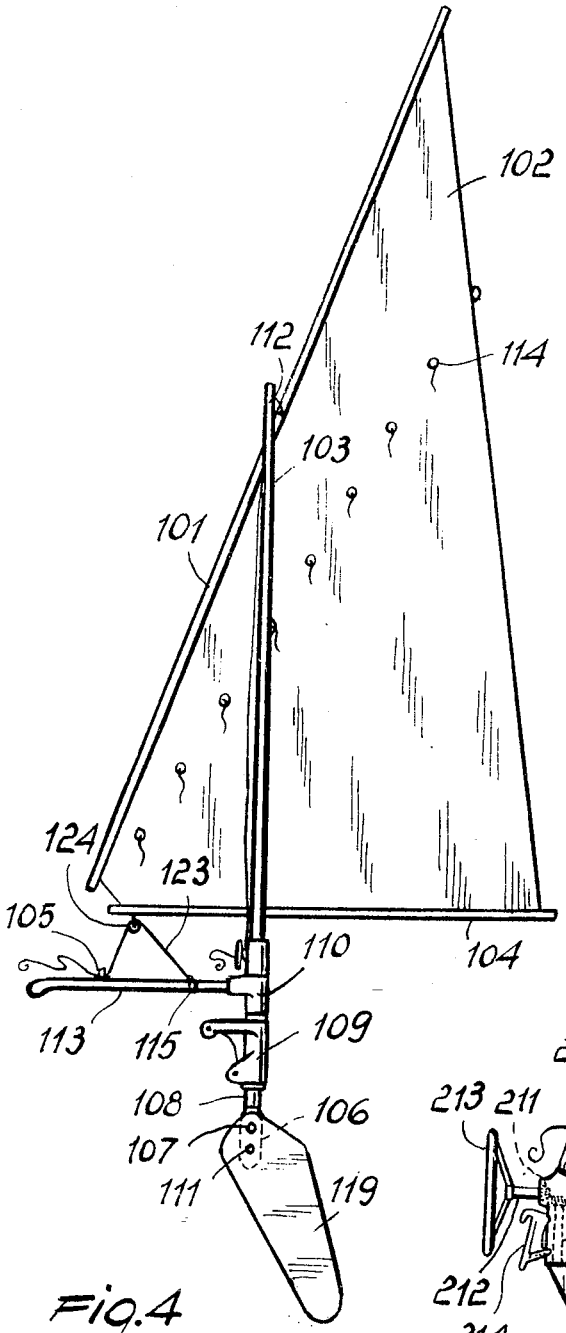
FIGS. 4 and 5 are schematic elevational views of the left-hand or port side of two modifications of the embodiment in FIG. 1, somewhat simplified for clarity.
Figure 5:
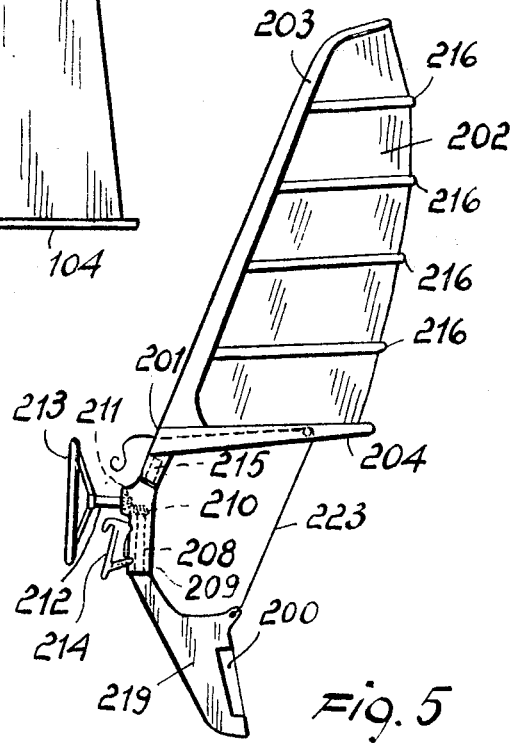

FIGS. 4 and 5 of the drawings show in a schematic form important variations with respect to the embodiment illustrated in FIGS. 1 and 2.

FIG. 4 shows how by adopting a so-called "lateen" sail 102, also of high aspect ratio, provided with a boom 104 and a spar 101 which is hoisted up the mast 103 by a conventional halyard arrangement, it becomes possible to provide a different interconnection of the sail 102 and fin 119. The supporting means 109, the attaching means to the boat (not shown), the sleeve member 110 and the tube 108 are substantially similar to the means 9, 14, 16 and 17, and members 10 and 8 in FIG. 1, respectively. The tiller 113 is preferably longer than the tiller 13 in FIG. 1 and provided with a known element 115 for attaching the sheet 123, said sheet 123 being led through a block 124 attached to that portion of the boom 104 which extends forward of the mast, and ending in a cam cleat 105 or equivalent thereof. It will appear how in this embodiment the side force of the sail is transferred by way of the tiller 113, sleeve member 110, tube 108, to the fin 119. Conventional means, such as the reef points 114, allow for the sail area to be reduced in a known manner. It should be noted that the boom 104 is, of preference, pivotally connected to the mast 103 through a simple ring or eye (not shown) made of plastic material which surrounds the mast and is fastened tangentially to the boom 104 by means of bolts. It should be further noted that it is no longer required that the mast be rotatable about its own axis, and the mast may be a wooden pole removably inserted into the upper end of the tube 108, purposely left open. This embodiment also shows a different configuration for the fin. Whereas in the embodiment shown in FIGS. 1 and 2, the fin 19 was a substantially flat plate, the fin 119 has advantageously a symmetrical double convex sectional profile which may be, as in a tested prototype, the wing section known as "Goettingen 444", only slightly thicker. A flat termination or tail portion 106 of the tube 108 is inserted into the hollow internal structure of the fin 119, whereto it is secured by means of a transverse element in form of a through bolt 107 and a transverse element in form of a pin, located below the bolt 107 and designated in FIG. 4 with the numeral 11, said pin being inserted in one of a set of through holes in the fin in order to permit adjustment of the angular position of the latter about the bolt 107. The pin 111 may be of phosphor bronze such as to have a shear strength smaller than that of the bolt 107 so as to shear off first with respect to the bolt 107, should the fin 119 collide violently, thereby permitting the fin 119 to tilt safely upwards by rotation about the bolt 107. It should be noted, moreover, that the thick and hollow configuration of the fin 119 ensures also a certain buoyancy effect which counterbalances, at least in part, the unit's own weight. By using specially light weight materials, it should be possible to design the unit according to the invention such that its weight on the boat is neutralized by its buoyancy.

FIG. 5 shows, by way of example, an embodiment of the unit which is particularly suitable for a large-size racing version thereof, but which, however, lends itself ideally to the production of a model toy. The rearward inclination or rake after of the mast 203, and correspondingly of the fin 219, may favor an application of the unit to twin hulled boats, or catamarans, in a more or less centered position.

The mast 203 and boom 204 are assembled to form a single component comprising a suitably streamlined fiberglass structure, or structure of other suitable material. The sail 202 is of the semirigid type having cross battens 216. The upper propulsive structure is journaled on a stub shaft 215 through intervening bearings (not shown), the stub shaft being in turn mounted to supporting means 209. The supporting means 209 comprises a hollow streamlined case, for example of fiberglass or aluminium. The fin 219, of fiberglass or other suitable material and having a symmetrical double convex sectional profile, is of hollow construction and rotates together with a hollow vertical pivot member or shaft 208, e.g. of steel, which is journaled in bearings (not shown) within the case 209. The fin 219 is additionally provided with a tab 200, which is rotatable at its leading edge about pivot elements affixed to the fin 219 in order to increase said side resistance or lift force developed by the sectional profile, by altering the geometry of the fin sectional profile, and this particularly when sailing to windward. The tab 200 may be controlled, e.g. through guided steel wire means, such as the control cables used conventionally in the outboard motor art, said guided steel wire being routed within the fin 219, up and through the hollow shaft 208 wherefrom it emerges at the top, terminating outside the case 209 at a suitable point whereat a brakeable control lever (not shown) would be located. The rotation of the fin assembly 219 may be achieved by operating a wheel 213 which would be connected with a substantially integral shaft 212 to one of a pair of bevel gears 211, and 210 located inside the case 209, the gear 210 being mounted to the open upper end of the hollow shaft 208. The sail would be controlled by means of a sheet 223 attached on one end to the fin 219, similar to the embodiment shown in FIGS. 1 and 2, but routed over a pulley inside the boom 204 and out through a hole 201 at the forward end of the boom, where a ratchet type of winch or other means may be provided to ensure an adequate mechanical advantage for the operator to trim the sheet. The attaching means 214 may be of the type used in some big outboard motors, wherein an automatically lockable mechanism ensures an upward tilting movement of the whole system in case a submerged obstruction is hit.

In view of the destination of the embodiment shown in FIG. 5, it is not considered necessary to provide reefing or sail area reducing means, since in the emergency it should suffice to let the sail flutter downwind by rotation of the whole assembly including 202, 216, 203 and 204 about the stub shaft 215, as it is generally done with rigid sails.

It is apparent, moreover, that the unit according to the invention may alternatively be provided with a rigid wingsail of the type adopted in some large racing catamarans, and that the various approaches hereinabove described may be interchanged among the embodiments illustrated.

Numerous alternative embodiments and modes of practicing the invention, but well within the spirit thereof, will in the light of this disclosure occur to persons conversant with the art.

It is therefore intended that the description herein be taken merely as illustrative, and not construed in any limiting sense.

I claim:

1. A detachable boat steering and sail propulsion unit, said unit being self-contained and removably attachable to the structure of a boat, comprising supporting means and attaching means for removably securing the unit to said boat, an upper propulsive structure carried by said supporting means and including a sail arranged for rotation through 360° about a substantially vertical axis and provided with means for the spreading handling and trimming of said sail, a lower normally immersed steering structure journaled in said supporting means for rotation about a substantially vertical axis independently of said upper structure, manually operated steering means for controlling said steering structure, said propulsive structure and said steering structure being arranged with respect to the axis of rotation thereof so that the side force application center of said sail and the center of application of the side resistance correspondingly opposed by said lower structure are both located with respect to the direction of advance of said boat abaft or behind the rotation axes respectively of said sail and lower steering structure, and wherein said sail trimming means is interconnected to said lower steering structure such as to transfer part of the side force acting on said sail to said lower steering structure, thereby counteracting the torque set up by said lower steering structure about the substantially vertical rotation axis thereof due to the leeway-preventing action of said interconnected steering structure.

2. A unit according to claim 1, wherein said supporting means is a rigid structure rotatably supporting a pivot member defining a support for a sail holding mast, said mast being rotatable about a substantially vertical axis through an arc of 360° on said pivot member, said rigid structure being pivotally connected to said attaching means for rotation about a horizontal axis such as to permit said rigid structure to oscillate in a vertical plane, means being provided for securing said rigid structure in a desired angular position on said attaching means.

3. A unit according to claim 2, wherein said lower steering structure is removably attached to the bottom end portion of said pivot member for rotation therewith annd wherein the unit further comprises a tiller means removably mounted on an upper portion of said pivot member for controlling rotation of said pivot member.

4. A unit according to claim 1, wherein said lower steering structure is attached to the bottom end portion of said pivot member and wherein the unit further comprises a pair of bevel gears mounted within said supporting means for rotating said lower steering structure together with said pivot member, one of said gears being affixed to said pivot member and the other one of said gears to a shaft which extends radially with respect to said pivot member and is journaled in said supporting means, a wheel type of helm or steering means being secured on said shaft outside said supporting means.

5. A unit according to claim 3, wherein said lower steering structure comprises a fin or plate element journaled to said bottom end portion and means for pivoting said element out of water.

6. A unit according to claim 3, wherein said lower steering structure comprises two identical plate elements journaled to said bottom end portion and arranged in a side by side relationship, the normally immersed portions whereof have outer faces which are more convex in sectional profile than the inner confronting faces, means being provided for individually pivoting each plate element out of water.

7. A unit according to claim 2, wherein said lower steering structure comprises an extension of the lower portion of said pivot member and a fin element having a symmetrical double-convex sectional profile mounted on said extension, said fin element being at least in part of hollow construction such as to acccomodate therewithin said extension whereto said fin member is affixed by two transverse elements, one of said transverse elements having a shear strength which is greater than the shear strength of the other element.

8. A unit according to claim 1, wherein said lower steering structure configuration and construction are such as to ensure a buoyancy effect counterbalancing at least in part the own weight of said steering structure.

* * * * *